US005686782A

United States Patent [19]

Hecker, Jr. et al.

[11] Patent Number: 5,686,782

[45] Date of Patent: *Nov. 11, 1997

[54] FIELD EMISSION DEVICE WITH SUSPENDED GATE

[75] Inventors: Phil E. Hecker, Jr., Garland; Robert E. Yui; Jules David Levine, both of Dallas, all of Tex.

[73] Assignee: Texas Instruments Incorporated, Dallas, Tex.

[ * ] Notice: The term of this patent shall not extend beyond the expiration date of Pat. No. 5,621,272.

[21] Appl. No.: 453,594

[22] Filed: May 30, 1995

[51] Int. Cl.[6] ..... H01J 1/30

[52] U.S. Cl. ..... 313/309; 313/336; 313/351

[58] Field of Search ..... 345/74, 75; 313/309, 313/336, 351, 310, 495, 496, 497

[56] References Cited

U.S. PATENT DOCUMENTS

| | | | |
|---|---|---|---|
| 3,453,478 | 7/1969 | Shoulders et al. | 313/336 |
| 3,755,704 | 8/1973 | Spindt et al. | 313/309 |
| 3,812,559 | 5/1974 | Spindt et al. . | |
| 4,857,161 | 8/1989 | Borel et al. | 204/192.26 |
| 4,874,981 | 10/1989 | Spindt | 313/309 |
| 4,940,916 | 7/1990 | Borel et al. | 313/306 |
| 5,194,780 | 3/1993 | Meyer | 315/35 |
| 5,225,820 | 7/1993 | Clerc | 340/752 |

FOREIGN PATENT DOCUMENTS 2687839 8/1993 France .

*Primary Examiner*—Sandra L. O'Shea
*Assistant Examiner*—Vip Patel
*Attorney, Agent, or Firm*—Warren L. Franz; Wade James Brady, III; Richard L. Donaldson

[57] ABSTRACT

An electron emitter plate (110) for an FED image display has an extraction (gate) electrode (22) spaced by a dielectric insulating spacer (125) from a cathode electrode including a conductive mesh (18). Arrays (12) of microtips (14) are located in mesh spacings (16), within apertures (26) formed in clusters (23) in extraction electrode (22). Microtips (14) are deposited through the apertures (26). The insulating spacer (125) is etched to undercut electrode (22) to connect apertures, forming a common cavity (141) for microtips (14) within each mesh spacing (16). Support beam structures (143) are deposited onto extraction electrode (22), either separately or simultaneously with formation of the microtips (14). The support beam structures (143) span the cavity (143) to support the extraction electrode (22) above the cathode electrode over cavity (143). The etch-out reduces the dielectric constant factor of gate-to-cathode capacitance in the finished structure. Strengthening the gate (22) with structures (143) enables gate support over the cavity (141).

13 Claims, 8 Drawing Sheets

FIELD EMISSION DEVICE WITH SUSPENDED GATE

TECHNICAL FIELD OF THE INVENTION

The present invention relates generally to electron emitting structures of the field emission type; and, in particular, to reduced cathode-to-gate capacitance arrangements for microtip emission cathode structures usable in FED field emission flat-panel image display devices.

BACKGROUND OF THE INVENTION

Examples of conventional electron emitting devices of the type to which the present invention relates are disclosed in U.S. Pat. Nos. 3,755,704; 3,812,559, 4,857,161; 4,940,916; 5,194,780 and 5,225,820. The disclosures of those patents are incorporated herein by reference.

A typical such structure, embodied as an electron emitter of an FED (field emission device) flat-panel image display device as described by Meyer in U.S. Pat. No. 5,194,780, is shown in FIGS. 1–5. Such device includes an electron emitter plate 10 spaced across a vacuum gap from an anode plate 11 (FIG. 1). Emitter plate 10 comprises a cathode electrode having a plurality of cellular arrays 12 of n×m electrically conductive microtips 14 formed on a resistive layer 15, within respective mesh spacings 16 (FIG. 2) of a conductive layer mesh structure 18 patterned in stripes 19 (referred to as "columns") (FIG. 5) on an upper surface of an electrically insulating (typically glass) substrate 20 overlaid with a thin silicon dioxide ($SiO_2$) film 21. An extraction (or gate) electrode 22 (FIGS. 1–3) comprises an electrically conductive layer of cross-stripes 24 (referred to as "rows") (FIG. 5) deposited on an insulating layer 25 which serves to insulate electrode 22 and space it from the resistive and conductive layers 15, 18. Microtips 14 are in the shape of cones which are formed within apertures 26 through conductive layer 22 and concentric cavities 41 of insulating layer 25. The microtips 14 are formed utilizing a variation of the self-alignment microtip formation technique described in U.S. Pat. No. 3,755,704, wherein apertures 26 and cavities 41 are etched after deposition of layers 22, 25 and wherein a respective microtip 14 is formed within each aperture 26 and cavity 41. The relative parameters of microtips 14, insulating layer 25 and conductive layer 22 are chosen to place the apex of each microtip 14 generally at the level of layer 22 (FIG. 1). Electrode 22 is patterned to form aperture islands or pads 27 centrally of the mesh spacings 16 in the vicinity of microtip arrays 12, and to remove cross-shaped areas 28 (FIG. 3) over the intersecting conductive strips which form the mesh structure of conductor 18. Bridging strips 29 of electrode 22 are left for electrically interconnecting pads 27 of the same row cross-stripe 24.

Anode plate 11 (FIG. 1) comprises an electrically conductive layer of material 31 deposited on a transparent insulating (typically glass) substrate 32, which is positioned facing extraction electrode 22. The conductive layer 31 is deposited on an inside surface 33 of substrate 32, directly facing gate electrode 22. Conductive layer 31 is typically a transparent conductive material, such as indium-tin oxide (ITO). Anode plate 11 also comprises a phosphor coating 34, deposited over the conductive layer 31, so as to be directly facing and immediately adjacent extraction electrode 22.

In accordance with conventional teachings, groupings of the microtip cellular arrays 12 in mesh spacings 16 corresponding to a particular column-row image pixel location can be energized by applying a negative potential to a selected column stripe 19 (FIG. 5) of cathode mesh structure 18 relative to a selected row cross-stripe 24 of extraction electrode 22, via a voltage source 35, thereby inducing an electric field which draws electrons from the associated subpixel pluralities of n×m microtips 14. The freed electrons are accelerated toward the anode plate 11 which is positively biased by a substantially larger positive voltage applied relative to extraction electrode 22, via the same or a different voltage source 35. Energy from the electrons emitted by the energized microtips 14 and attracted to the anode electrode 31 is transferred to particles of the phosphor coating 34, resulting in luminescence. Electron charge is transferred from phosphor coating 34 to conductive layer 31, completing the electrical circuit to voltage source 35.

The various column-row intersections of stripes 19 of cathode mesh structure 18 and cross-stripes 24 of extraction electrode 22 are matrix-addressed to provide sequential (typically, row-at-a-time) pixel illumination of corresponding phosphor areas, to develop an image viewable to a viewer 36 looking at the front or outside surface 37 of the plate 11. However, even with row-at-a-time addressing, the per pixel addressing duty factor is small. For example, the pixel dwell time (fraction of frame time available to excite each pixel) for row-at-a-time addressing in a 640×480 pixel color display refreshed at 60 frames per second (180 RGB color fields per second), is only about 8–10 microseconds per row. This means that for pulsewidth modulated gray scale control, where the dwell time per pixel is further divided into as many as 64 dwell time subintervals, column voltage switching during row "on" times occurs at the rate of about once every 30–40 nanoseconds. At such high switching rates, total gate-to-cathode capacitance for the column stripes 19 becomes a significant factor in the RC time constant and has a predominant adverse influence on the $\frac{1}{2}CV^2$ power consumption factor. Some reduction in capacitance is achieved through the described patterning of gate electrode 22, wherein removal of gate electrode from areas 28 reduces capacitance away from the microtips. There remains, however, a pressing need to reduce the column gate-to-cathode capacitance even more in such field effect devices.

Spindt, et al., U.S. Pat. No. 3,812,559 (see FIG. 9 of the '559 patent) illustrates a conventional microtip emission cathode structure wherein a gate electrode is supported only at its periphery. This reduces gate-to-cathode capacitance due to the elimination of most of the gate-supporting dielectric material present in structures such as that of Meyer '780, which have insulating material 25 completely surrounding each microtip 14. The '559 structure has no supports except at the periphery of the entire gate electrode and has the advantage of reducing capacitance especially for high frequency (viz. microwave frequency) operations wherein gate-to-cathode capacitance has particularly adverse consequences. The Spindt '559 structure is, however, subject to several problems. First, except for very small structures, the lack of any support except at the periphery can lead to excess bouncing or vibration of the gate electrode, similar to vibrations encountered by a peripherally supported membrane. This so-called "trampoline" effect can lead to structure failure and undesirable variations of gate-to-cathode current flow. The large unsupported central region is also subject to other problems. In assembly of a display structure, glass balls or other spacers acting between the anode and cathode plates may cause unwanted physical deformation and even destruction of an unsupported gate. Also, during fabrication, surface tension of etching liquids used in wet etching steps (such as for removal of a sacrificial Ni layer) can cause the unsupported structure to break when the liquids are recovered. The unsupported gate region may also be subject to distortion due to electrical attraction between the positively charged gate and the negatively charged cathode.

SUMMARY OF THE INVENTION

The present invention provides an electron emitting structure of the field emission type having reduced cathode-to-gate capacitance. In particular, the invention provides a thin-film microtip emission cathode structure with reduced column cathode-to-gate dielectric constant, achieved through reduction in the mass of the insulating layer that serves to space cathode and gate electrode layers.

In accordance with embodiments of the invention, described further below, a field emission cathode structure formed using a self-aligning microtip fabrication process is given an exaggerated undercut etching, either during or after formation of the gate electrode apertures, thereby reducing the amount of insulating spacer material between aperture pads of the gate electrode and associated microtip cellular arrays of the cathode electrode. In illustrated embodiments, described in greater detail below, etching is controlled so that microtips associated with each aperture lattice cluster are formed within a common cavity. Pads patterned in the gate electrode are located centrally over the cathode mesh spacings, supported peripherally on cavity outer walls. A beam structure is formed on the gate electrode, within each mesh spacing, to span the associated cavity and support the gate electrode centrally over the cavity, above the cathode electrode. The beam structure may take a variety of forms, including a simple longitudinal strut, a cross-shape, a dog-leg shape, and a zigzag pattern. In one method of fabrication, the beam structure is formed by separate patterning and deposition steps wherein a layer of beam-forming material is deposited over the gate electrode after formation of the microtips. In another method of fabrication, the beam structure is patterned in a lift-off layer and is formed simultaneously with and of the same material as the microtips.

By eliminating the insulating spacer material between the cathode mesh spacings and the gate pads in the vicinity of the apertures, the average dielectric constant between the cathode and gate electrodes for each column is significantly reduced, thereby leading to an overall reduction in column cathode-to-gate capacitance. This reduces the RC time constant and the total power consumption of the resulting matrix-addressed pixel image. Suspending the pads using support beam structures alleviates the problem of trampolining and other deformations previously described.

BRIEF DESCRIPTION OF THE DRAWINGS

Embodiments of the invention have been chosen for the purpose of illustration and description, and are shown with reference to the accompanying drawings, wherein:

FIG. 1 is a view of the display corresponding to a section taken along the line 1—1 of FIGS. 2 and 4;

FIG. 2 is a top plan view of a portion of a pixel of the image forming area of the cathode plate of the display;

FIG. 3 is a view of the cathode plate laterally displaced from that of FIG. 1, corresponding to a section taken along the line 3—3 of FIGS. 2 and FIG. 4 is an enlarged top plan view, with gate electrode layer removed, of a central region of one subpixel mesh spacing of the display; and FIG. 5 is a schematic macroscopic top view of a corner of the cathode plate useful in understanding the row-column, pixel-establishing intersecting relationships between the cathode grid and pad-patterned gate electrodes shown in greater enlargement in FIG. 2.

FIGS. 6 and 7 are section views, taken along the lines 6—6 and 7—7 of FIG. 8 and respectively corresponding to the views of FIGS. 1 and 3, of a display incorporating an electron emitting structure in accordance with the invention;

FIG. 8 is a view corresponding to that of FIG. 3, except that the gate electrode layer and mesh structure are shown in FIG. 8;

FIGS. 9A–9E are schematic views showing exemplary alternative support beam structure arrangements;

FIGS. 10A–10H are schematic views showing steps in a method of fabrication of the structure of FIGS. 6–8; and FIGS. 11A –11C are schematic views showing a modification of the method of FIGS. 10A–10H.

Throughout the drawings, like elements are referred to by like numerals.

DETAILED DESCRIPTION OF PREFERRED EMBODIMENTS

Figure 6:
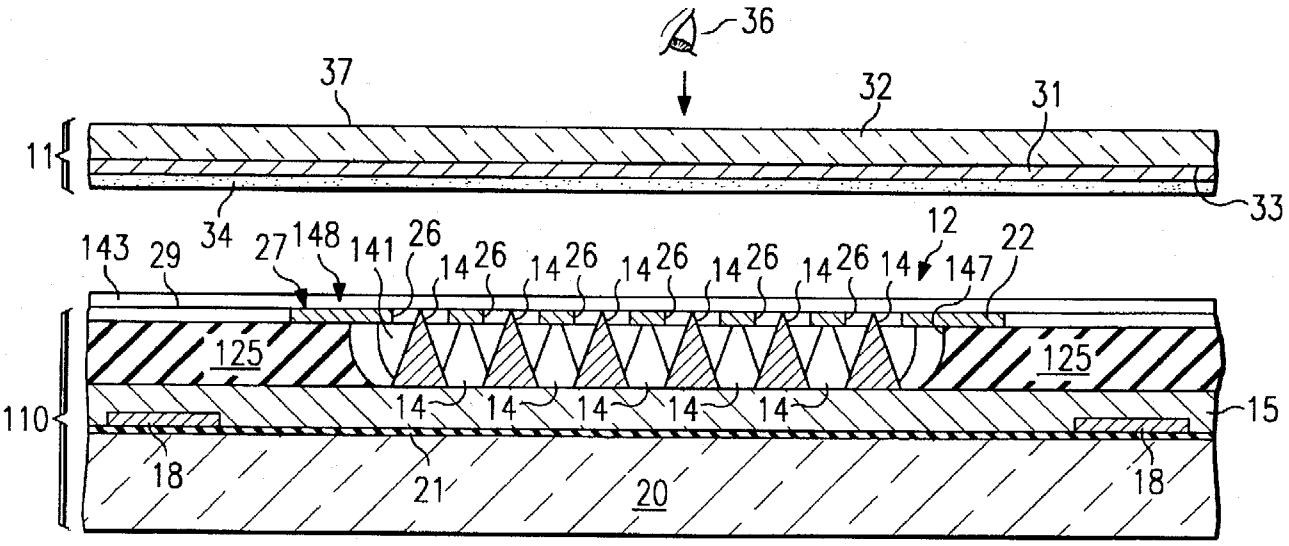
FIGS. 6–8, 9A–9E, 10A–10H and 11A–11C illustrate embodiments of the invention.
Figure 7:
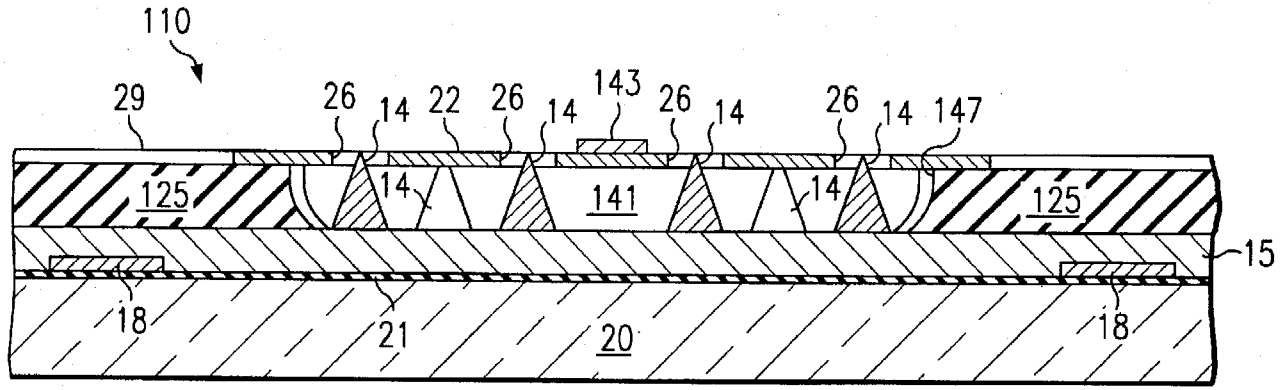
Figure 8:
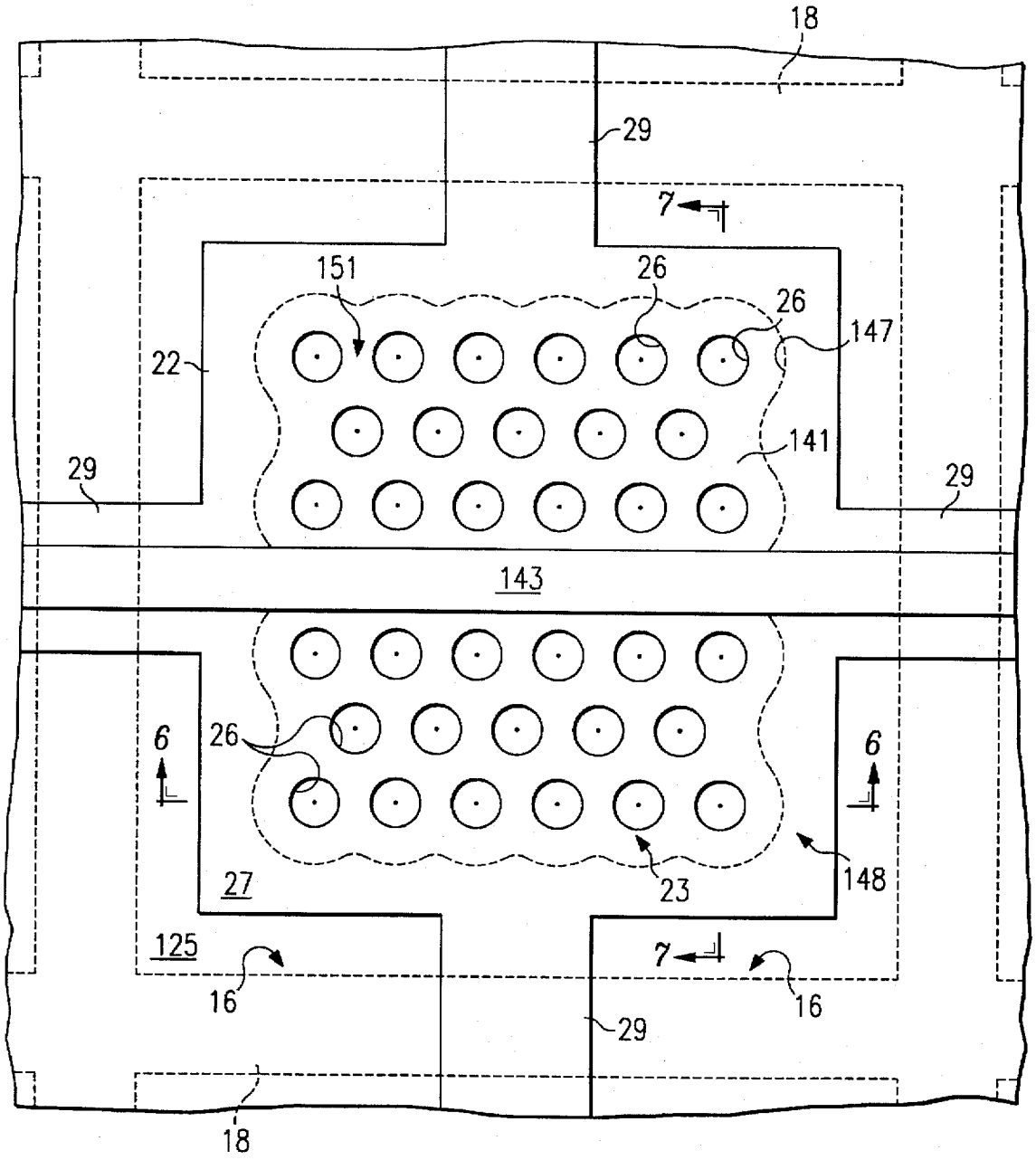

FIGS. 6–8 illustrate an embodiment of an FED flat-panel image display device, incorporating an electron emitter plate 110 fabricated in accordance with the teachings of the present invention.

As with the device of FIGS. 1–5, the emitter plate 110 is spaced across a vacuum gap from an anode plate 11, which may be identical to the anode plate 11 previously described. Likewise, in conformance with the previously described emitter plate 10, emitter plate 110 generally comprises a cathode electrode having a plurality of clusters 12 of similar electrically conductive microtips 14 formed in cellular arrays on a resistive layer 15, within respective mesh spacings 16 (see FIGS. 2 and 8) of a conductive layer mesh structure 18 patterned in column stripes 19 (see FIG. 5) on an upper surface of a glass or other substrate 20 overlaid with a thin silicon dioxide ($SiO_2$) film 21. Also, in conformance with the previously described emitter plate 10, the illustrated emitter plate 110 may have an extraction (or gate) electrode 22, patterned to form aperture islands or pads 27, each having a cluster 23 of apertures 26 arranged in one-to-one correspondence with the microtips 14 and located centrally over a respective cathode electrode mesh spacing 16. The extraction electrode 22 comprises an electrically conductive layer of row-defining cross-stripes 24 (see FIG. 5) that run transversely to the stripes 19 defined by the cathode electrode mesh structure 18.

Figure 1:
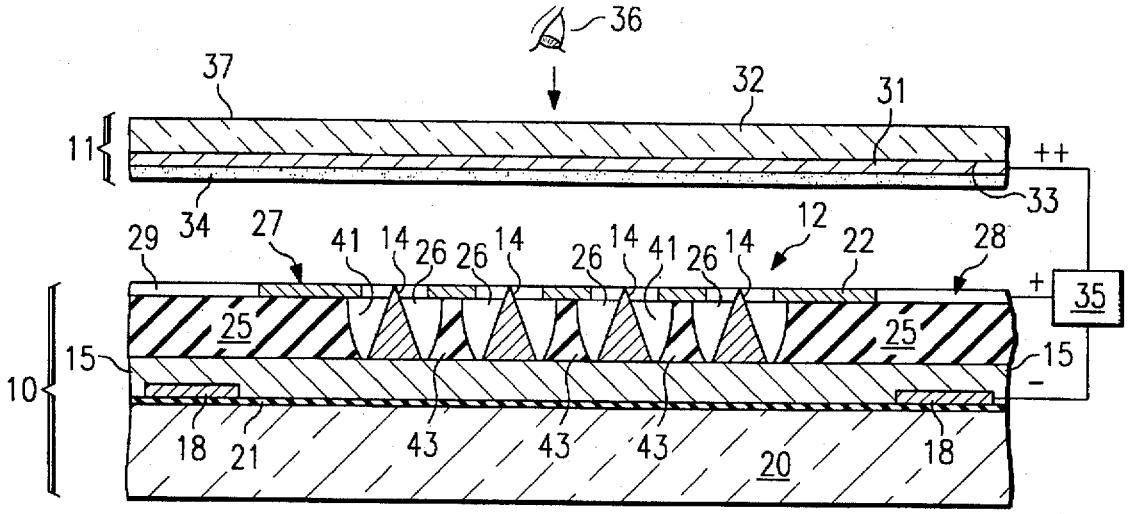
FIG. 1 (PRIOR ART)
FIGS. 1–5, already described and relating to the prior art, illustrate a typical "subpixel mesh" electron emitting structure fabricated utilizing conventional thin-film deposition techniques, and embodied in an FED flat-panel image display device.
Figure 2:
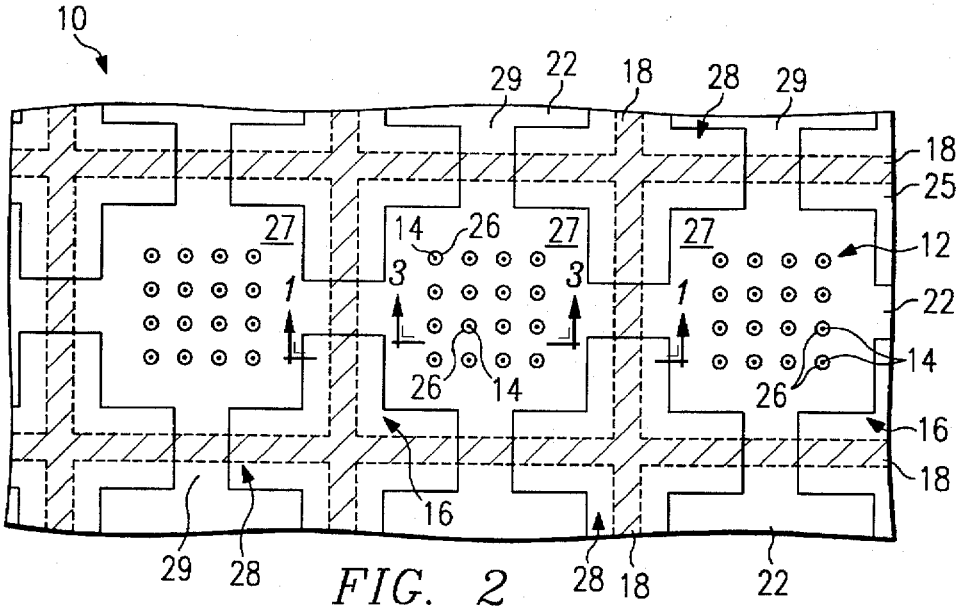
FIG. 2 (PRIOR ART)
Figure 3:
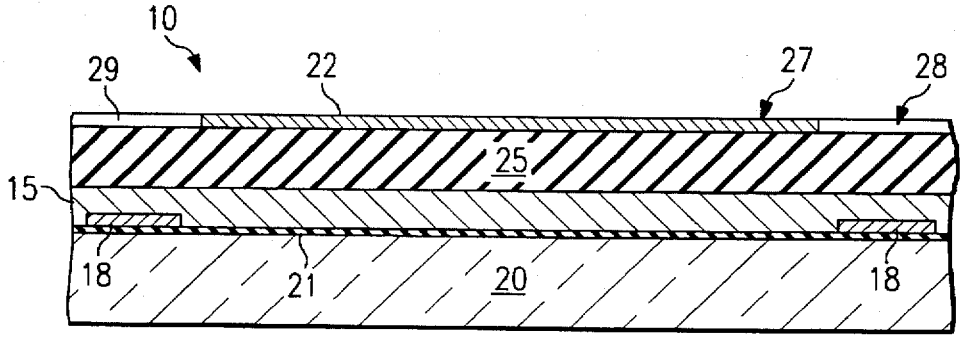
FIG. 3 (PRIOR ART)
Figure 4:
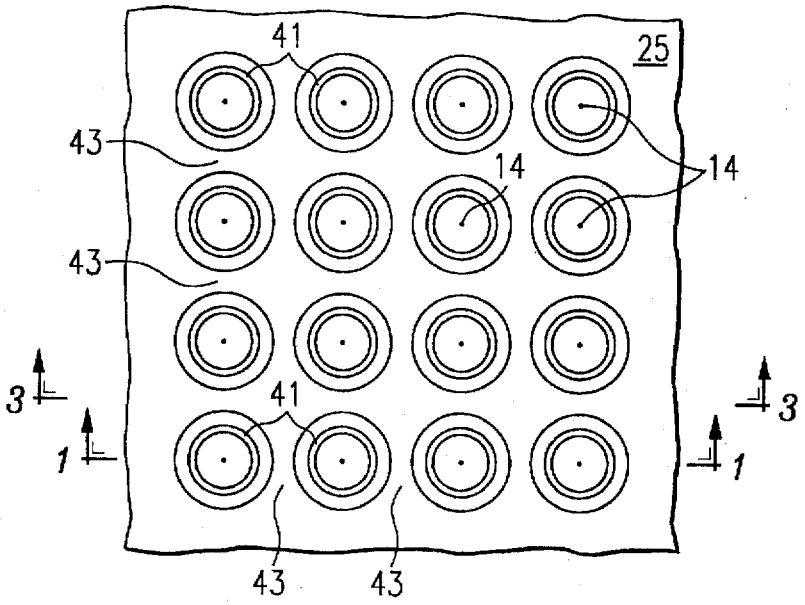
FIG. 4 (PRIOR ART)
Figure 5:
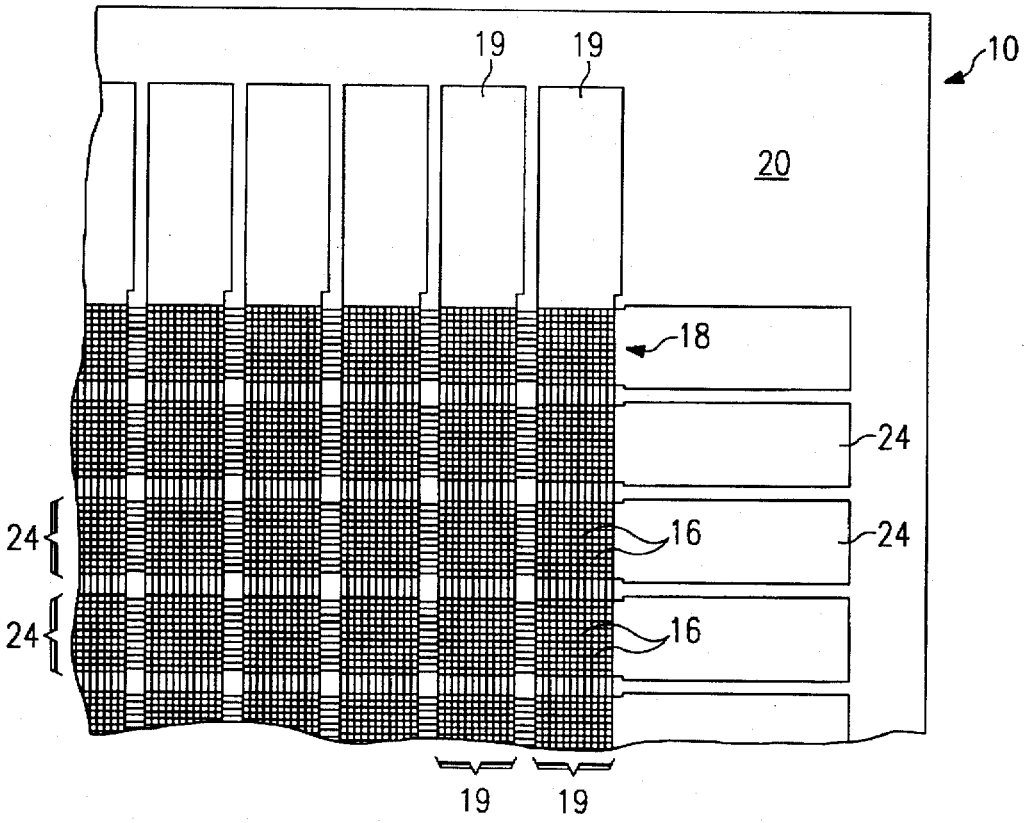
FIG. 5 (PRIOR ART)

Conductive layer 22 is spaced and insulated from resistive layer 15 and cathode mesh structure 18 by an intervening dielectric insulating layer 125 which corresponds to the layer 25 shown in FIGS. 1, 3 and 4. Unlike layer 25 however, layer 125 does not have discrete isolated cavities 41, formed concentrically about the site of each microtip 14, leaving unbroken partitions 43 separating adjacent ones of the cavities 41 of the microtips 14 of the same cluster 12 (see FIGS. 1 and 4). Instead, the mass of insulating layer 125 has been reduced to remove partitions 43 and provide microtips 14 of each cluster 12 commonly located in a shared larger cavity 141. As shown in FIG. 8, each cluster 23 of apertures 26 is arranged in an array located centrally of a pad 27, centrally of a mesh spacing 16. Similarly, the microtips 14 of each microtip cluster 12 are arranged in a like array, with a microtip 14 located within each one of the apertures 26. The partitions 43 are removed, with the apertures 26 of the same cluster 23 being connected by the common cavity 141. This reduction in mass of material 125 centrally of the mesh spacings 16 (see FIGS. 6–8) positions the microtips 14 of each array 12 within the same cavity 141 formed centrally within each mesh spacing 16. The gate electrode layer 22 is supported peripherally, marginally of each pad 27 on insulative material 125 (see FIG. 8) bordering the perimeter of cavity 141, on a boundary wall 147 defining the lateral extremities of cavity 141 of each array 12. The portion 148 of layer 22 that defines the marginal edge of each pad 27 is supported on boundary wall 147 (see FIGS. 6 and 8). The portion 151 of layer 22 that defines the central part of each pad 27 that extends over the top of cavity 141, is supported by suspension from a support beam structure 143 which spans the cavity 141, extending from one run of wall 147 to another.

The size of apertures 26 in the arrangement of FIGS. 6–8 can be the same as the size of apertures 26 in the arrangement of FIGS. 1–4, and similar self-alignment techniques can be used to obtain initial alignment for forming microtips 14 in general concentric alignment within apertures 26. Beyond this, however, the removal of dielectric from below the apertures 26 is increased above that utilized to obtain the prior art cavities 41. The traditional size of cavities 41 is expanded to the point where their diameters overlap and the partitions 43 are eliminated at least partially, and preferably completely.

Capacitance of the cathode plate structure 10 or 110 is proportional to the area and spacing of the separated conductive layers 18, 22 and to the magnitude of the dielectric constant of the material (viz. insulating layer 25 or 125) separating layers 18, 22. An electron emitting structure in accordance with the invention, as illustrated by the described cathode plate 110, has overall reduced capacitance because of reduced average dielectric constant resulting from elimination of insulating layer material (compare layer 125 with layer 25) and replacement of the same with the significantly lower dielectric constant of air (viz. vacuum), especially in the vicinity of highest electron concentration (viz. the microtip arrays 12, centrally of the mesh spacings 16). Accordingly, an image display device incorporating the principles of the invention exhibits a lower RC time constant and reduced $\frac{1}{2}CV^2$ power dissipation.

For the embodiment of FIG. 8, the partitions 43 are completely eliminated, leaving the central part 151 of pad 27 without direct support of underlying insulating material 125. Support for the central part 151 is instead provided by the support beam structure 143. As shown, each pad 27 has four sides respectively supported on a respective four runs of wall 147 of cavity 141. A bridging strip 29 extends outwardly, perpendicularly away from a midpoint of each pad side. The illustrated support beam structure 143 takes the form of a continuous linear strip or strut 160 of material deposited into adherence onto the gate electrode 22 in alignment with opposite aligned ones of the bridging strips 29. The array 23 of apertures 26 is patterned to leave an unapertured band or swath, separating the pad 27 into halves, and the strut 160 extends across the unapertured band, from one opposing bridging strip 29 to the other. The strut 160 represents a local thickening of the electrode layer 22 across the unapertured band and centrally of the opposing bridging strips 29. The insulating layer 125 internal to the boundary wall 147 of cavity 141 is removed, both from between neighboring apertures 26 and from below the unapertured band occupied by the strut 160. This arrangement significantly reduces the dielectric material 125 in the active emission area, thereby ameliorating the gate-to-cathode capacitance problem, and provides central support, through suspension, to the pads 27 with little loss in microtip density.

Figure 9A:
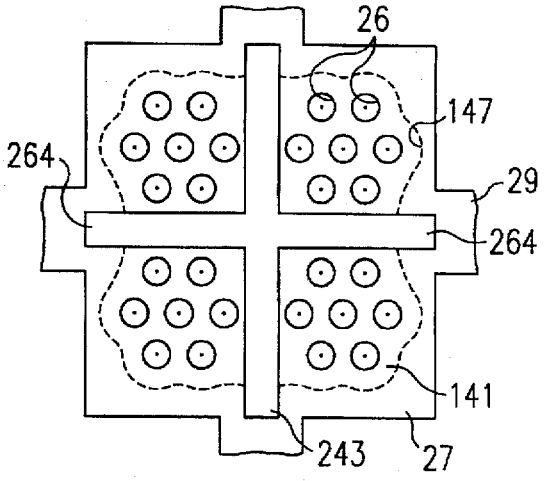
Figure 9B:
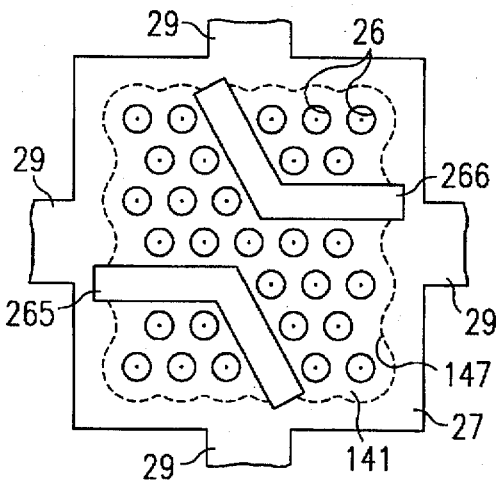
Figure 9C:
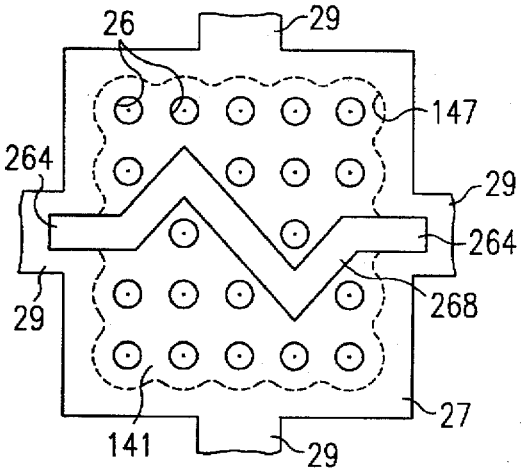
Figure 9D:
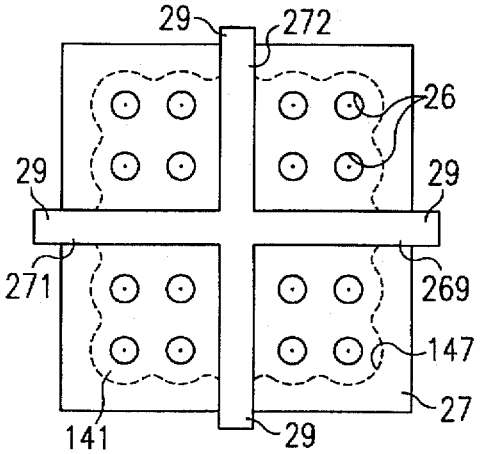
Figure 9E:
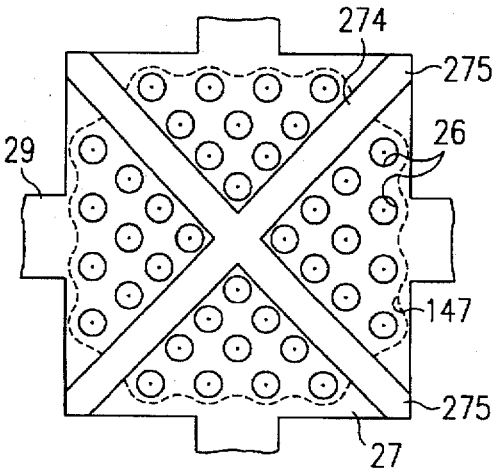

FIGS. 9A–9E illustrate various alternative implementations of the support beam structure 143. FIG. 9A shows a cross-shaped support beam structure 243, spanning the cavity 141 from top to bottom and left to right. The structure 243 has perpendicular, intersecting arms 261, 263. The arms do not extend across the bridging strips 29 from one pad 29 to another, but have opposite ends 264 that terminate beyond the wall 147, proximate respective junctures of pad 27 with bridging strips 29. FIG. 9B shows a support beam structure in the form of a pair of dog-leg shaped elbow beams 265, 266, one extending right and down, the other extending left and up, as illustrated. As with the structure 264, the beams 265, 266 terminate on the periphery of the pad 27, proximate junctures of pad 27 with bridging strips 29. FIG. 9C illustrates a support beam structure in the configuration of a zigzag-patterned beam 268 which spans the cavity 147 and has ends 264 terminating above the insulating material, beyond wall 147. FIG. 9D shows a cross-shaped patterning 269, wherein perpendicular intersecting strips 271, 272 that extend right-to-left and up-and-down, continuously, contiguous with the bridging strips 29. In this arrangement, the strips 271, 272 can be optionally constructed as thickened portions of the gate electrode 22 and can eliminate the need for separate bridging strips 29. In that case, the strips 271, 272 themselves connect one pad 27 to the next. FIG. 9E shows another cross-shaped support beam structure 274, making an "X" pattern across the pad 27 and having ends 275 terminating beyond the wall 147 at corners of pad 27. FIGS. 9A–9E illustrate various placements of apertures 26 in the aperture array on pad 27.

A conventional process for fabrication of thin-film microtip emission cathode structures of the type described with reference to FIGS. 1–5 is generally described in Spindt U.S. Pat. No. 3,755,704 and Meyer U.S. Pat. No. 5,194,780. Such process can be modified in accordance with illustrative embodiments of methods of the invention to fabricate the structures in accordance with the invention.

Figure 10A:
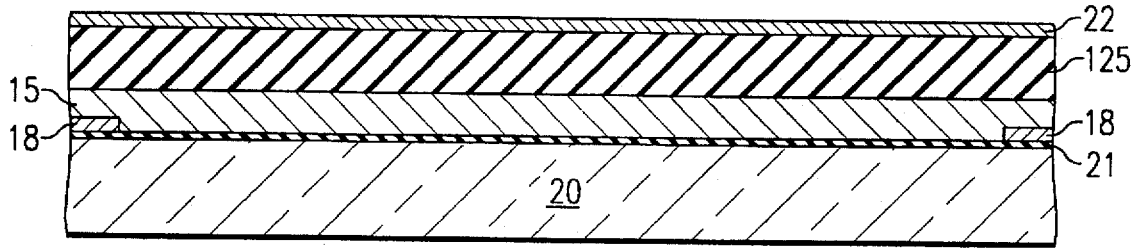

As shown in FIG. 10A (corresponding to the view of FIG. 7), a cathode mesh structure 18, resistive layer 15, insulating layer 125 and gate electrode layer 22 are successively formed on an upper surface of a glass substrate 20, which has been previously overlaid with a thin layer 21 of silicon dioxide ($SiO_2$) of about 500–1000 Å thickness. The cathode structure 18 may, for example, be formed by depositing a thin coating of conductive material, such as niobium of about 2,000 Å thickness, over the silicon dioxide layer 21. The mesh pattern of structure 18 and connectors defining the columns 19 may then be produced in the conductive coating by photolithography and etching to give, e.g., mesh-defining strips of 2–3 micron widths, providing 25–30 micron generally square mesh spacings 16, at 11×10 mesh spacings per 300 micron pixel, with column-to-column separations of 50 microns (see FIG. 5). Resistive layer 15 may, for example, be formed as a resistive, undoped silicon coating of, e.g., 10,000–12,000 Å thickness, deposited by cathode sputtering or chemical vapor deposition over the patterned mesh structure 18 and mesh spacings 16 (see FIG. 2). Spacer layer 125 may, for example, be formed as a silicon dioxide ($SiO_2$)

layer of 1.0–1.2 micron thickness deposited by chemical vapor deposition over the resistive coating 15. Gate electrode layer 22 may, for example, be formed by depositing a thin metal coating of niobium with, e.g., 2,000 Å thickness over the spacer layer 125.

Figure 10B:
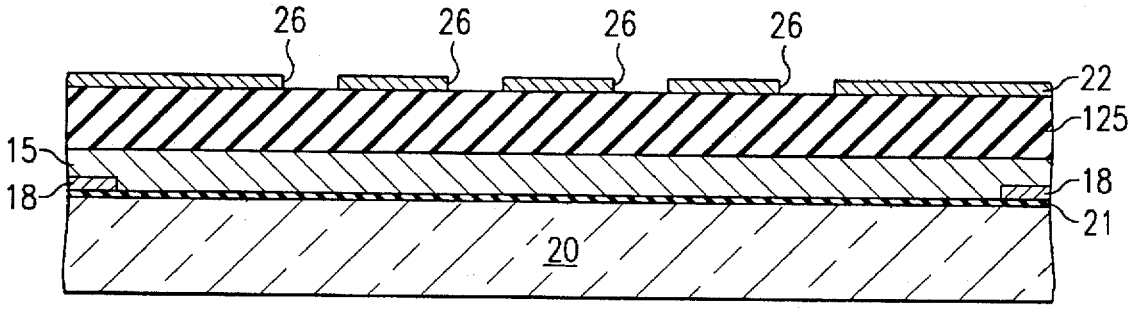
Figure 10C:
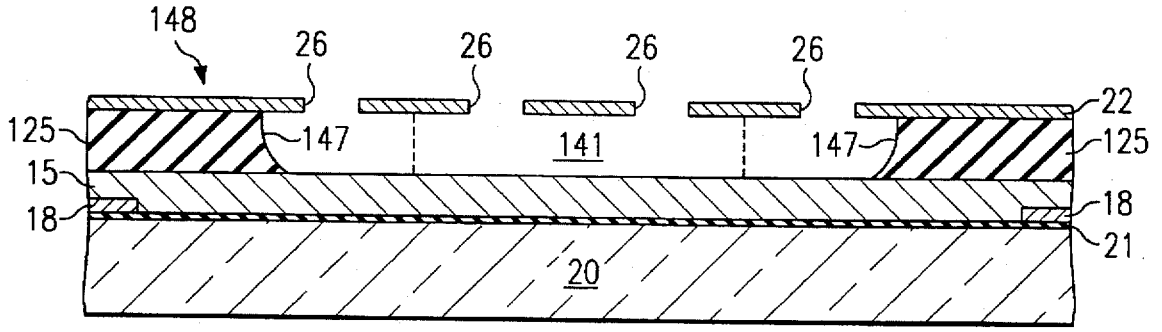

Next, as shown in FIG. 10B, gate layer 22 is masked and etched to define pluralities of apertures 26 of 1.0–1.4 micron diameters arranged in arrays at, for example, 25 micron array pitches. The insulating layer 125 is then subjected to a first dry etching to form pluralities of arrays of discrete cavities in respective concentric alignments with and located beneath the apertures 26. Layer 125 is then subjected to a wet etch (see FIG. 10C) to undercut the gate layer 22 away from the apertures 26 to remove the partitions 43 (see FIG. 1) between apertures 26 and form a single common cavity 141 that connects all apertures 26 of the same array. The bases of partitions 43 can be left, and the wet etching stopped as soon as the tops of the partitions become spaced from the gate layer 22, if desired. Otherwise, as indicated, the etch is continued until the partitions 43 are eliminated. The etch proceeds generally radially outwardly of the apertures 26. Thus, when the partitions 43 are gone and the etch stopped, cavity 141 will be left free of insulating dielectric material within the cavity interior bounded by wall 147.

Figure 10D:
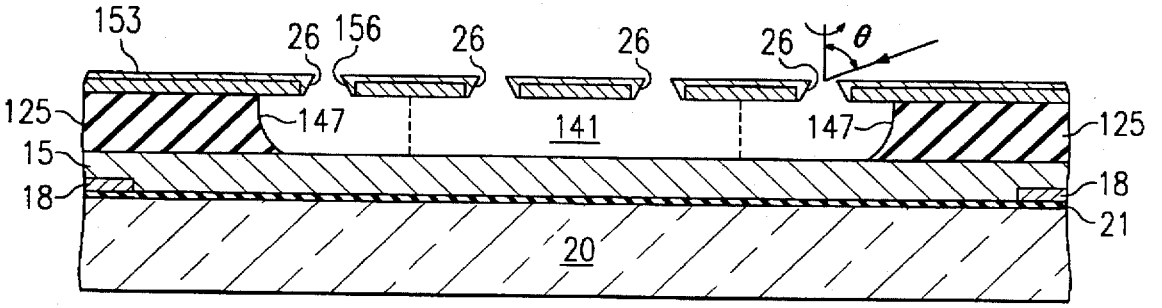
Figure 10E:
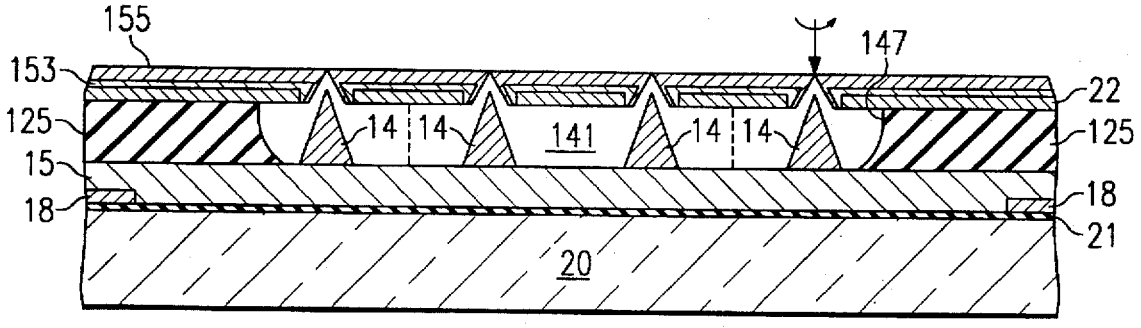
Figure 10F:
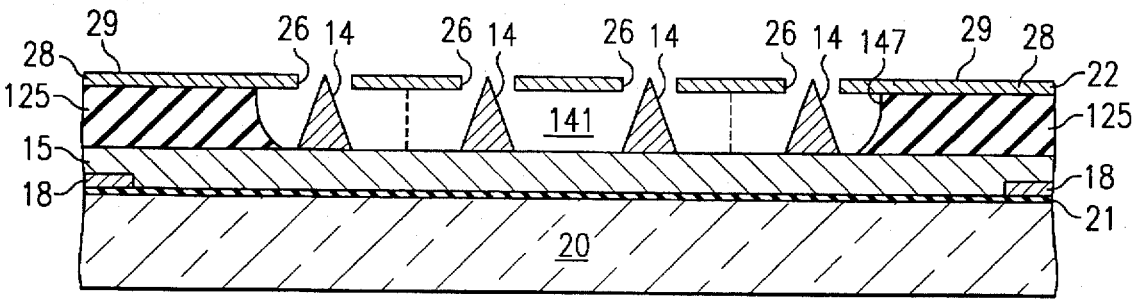

Thereafter, as shown in FIG. 10D, while rotating the substrate 20, a sacrificial lift-off layer 153 of, e.g., nickel is formed by low angle electron beam deposition over the layer 22. The beam is directed at an angle of 5°–20° to the surface (70°–85° from normal) so as to deposit lift-off layer material on the aperture circumferential walls at 156, and keep it out of the cavity 141. Then, as shown in FIG. 10E, with substrate 20 again being rotated, molybdenum and/or other conductive tip forming material is deposited on the inner surface of cavity 141 by directing a beam substantially normal to the apertures 26 to form microtips 14, self-aligned in respective concentric alignment within the apertures 26 and cavity 141. Then, as shown in FIG. 10F, superfluous molybdenum deposition 155 deposited over the nickel layer 153 is removed, together with the nickel layer 153.

Figure 10G:
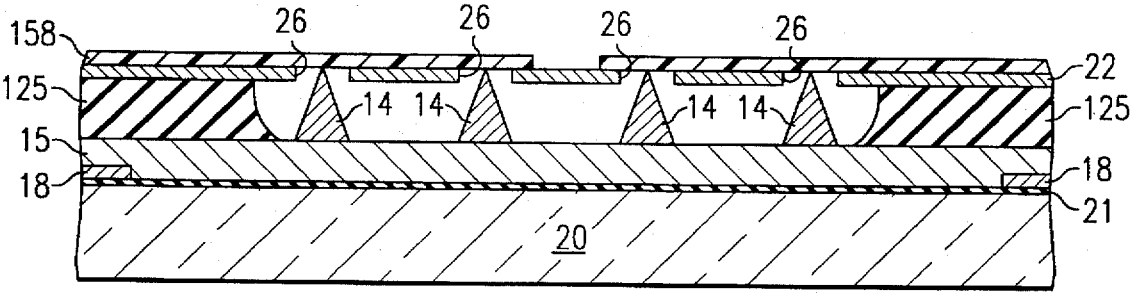
Figure 10H:
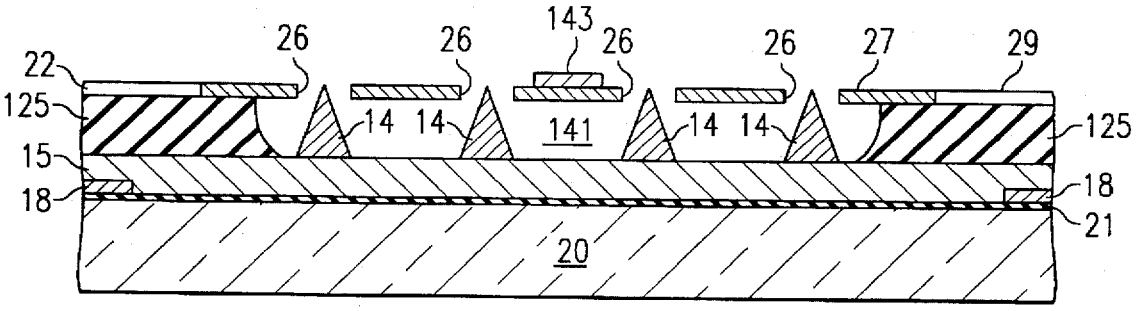

Next, as shown in FIG. 10G–10H, a layer of photoresist 158 is patterned to define the configuration of the support beam structure 143, and a layer of material is deposited onto the gate layer 22 to define the support beam structure 143 (FIG. 10H). Subsequent masking and etching is used to pattern the apertured layer 22, to define the row cross-stripes 24 (see FIG. 5), the pads 27 and the bridging strips 29 (see FIGS. 3 and 10 F). Row cross-stripes 24 may, for example, be formed with widths of 300–400 microns and spacings of 50 microns. Pads 27 may be formed as nominal 15 micron squares centered at 25 micron pitches over mesh spacings 16 and with bridging strips 29 of 2–4 micron widths.

Figure 11A:
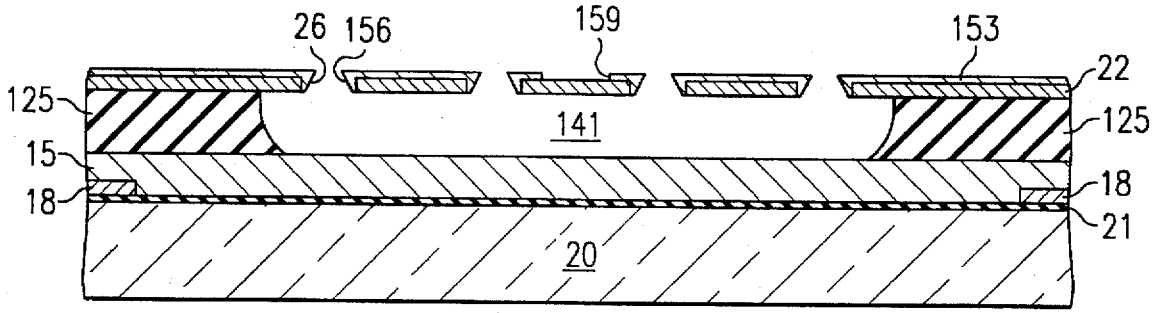
Figure 11B:
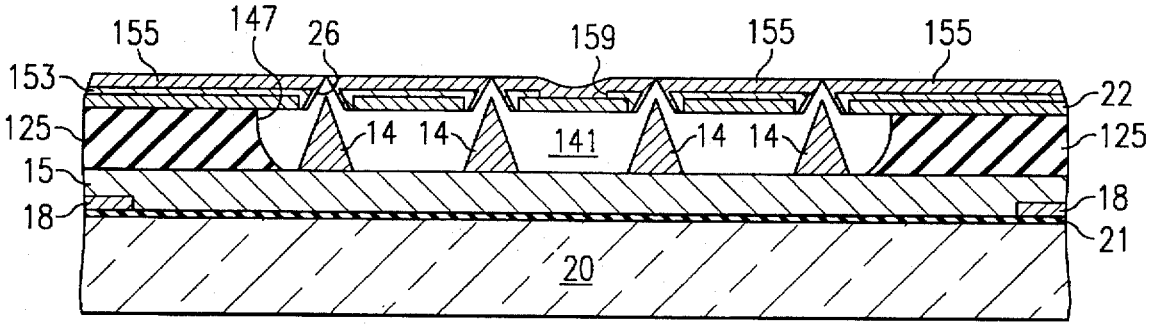
Figure 11C:
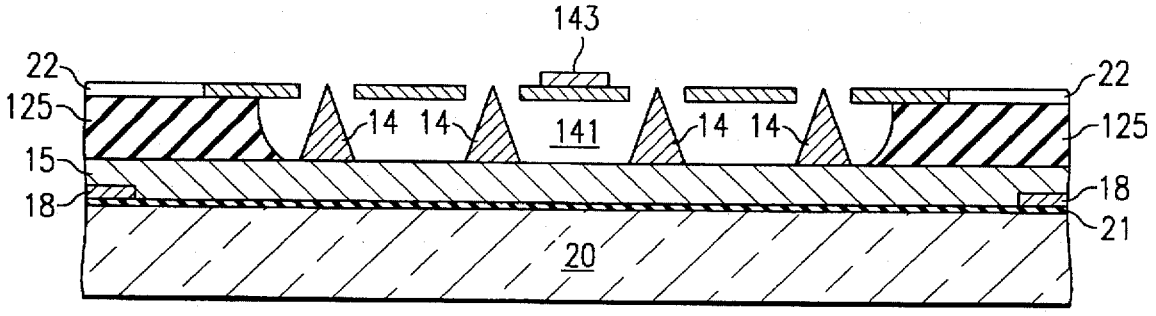

FIGS. 11A–11C illustrate an alternative sequence of fabrication of the support beam 143. Preliminary steps are as discussed with reference to FIGS. 10A–10D. However, in the deposition of the sacrificial lift-off layer 153, the nickel is either masked against deposition or etched to define a nickel-free region 159 (FIG. 11A) in the configuration of the desired support beam structure 143. Then, as shown in FIG. 11B, when the molybdenum or other tip forming material 155 is deposited over the lift-off layer 153, material 155 will be deposited into the region 159 onto the gate layer 22. When the excess material 155 is then removed with the lift-off layer, the material deposited in region 159 will be left, forming the support beam 143 as shown in FIG. 11C. This has the advantage of forming the support beam structure without the necessity for addition steps after the tips are formed.

The thickness of the layer 143 or residual layer 155 will vary according to the material utilized and the structural strength needed or desired. Where a material such as the tip forming molybdenum is utilized, a thickness equal to the thickness of layer 155 when the microtips 14 have been formed should be adequate. Such material will also bond well to the underlying conductive material used for the gate layer 22. Where a separate deposition step is employed, a different (even a nonconductive material) may be preferred. The use of a nonconductive material will ensure that interference with the electron emission performance of neighboring apertures is minimal.

In the illustrated embodiments, the cathode current flows to the microtips 14 through the conductive layer 18 and resistive layer 15. The ordering of the layers 15 and 18 may be reversed. Likewise, if desired, the microtips 14 of each subpixel array may be placed on or over a conductive plate located within each mesh spacing 16, spaced from the mesh structure strips. Other arrays of aperture clusters 23 and microtip clusters 12 are also possible. Moreover, a mesh may be formed in the gate electrode layer 22 either instead of, or in addition to, forming the mesh in the conductive layer 18. Those skilled in the art to which the invention relates will appreciate that yet other substitutions and modifications can be made to the described embodiments, without departing from the spirit and scope of the invention as defined by the claims below.

What is claimed:

1. An electron emitter plate comprising:

a substrate;

a first layer of conductive material deposited on said substrate;

a layer of insulating material deposited on said substrate over said first layer of conductive material;

a second layer of conductive material deposited on said substrate over said layer of insulating material; said second layer of conductive material having a plurality of apertures; said apertures extending through said insulating layer;

a conductive microtip formed in each aperture in electrical communication with said first layer of conductive material;

said insulating layer being formed with a cavity connecting said apertures and commonly containing said microtips; said insulating layer supporting said second layer of conductive material above said first layer of conductive material peripherally of said cavity; and a beam spanning said cavity and supporting said second layer of conductive material above said first layer of conductive material centrally of said cavity.

2. The electron emitter plate of claim 1, wherein said beam comprises a layer of material deposited over said second layer of conductive material.

3. The electron emitter plate of claim 2, wherein said beam layer of material is deposited in a cross-shaped pattern.

4. The electron emitter plate of claim 3, wherein said beam layer of material is deposited in a dog-leg shaped pattern.

5. The electron emitter plate of claim 1, wherein said beam layer of material is deposited in a zigzag pattern.

6. An electron emitter plate comprising:

a substrate;

a first layer of conductive material deposited on said substrate; said first layer of conductive material being patterned in a mesh structure defining a plurality of mesh spacings;

a layer of insulating material deposited on said substrate over said first layer of conductive material and said mesh spacings;

a second layer of conductive material deposited on said substrate over said layer of insulating material; said second layer of conductive material having a cluster of apertures located within each mesh spacing; said apertures extending through said insulating layer;

a conductive microtip formed in each aperture in electrical communication with said first layer of conductive material;

said insulating layer being formed with a cavity located within each mesh spacing, each cavity connecting the apertures of one of said clusters and commonly containing the microtips associated with that cluster; said insulating layer supporting said second layer of conductive material above said first layer of conductive material peripherally of each cavity; and a beam formed on said second layer of conductive material within each mesh spacing, said beam spanning the associated cavity and supporting said second layer of material above said first layer of conductive centrally of said cavity.

7. The electron emitter plate of claim 6, wherein said second layer of conductive material is patterned to form pads respectively located centrally within said mesh spacings, and said beams cooperate to form bridging strips electrically connecting said pads to neighboring pads; said aperture clusters being respectively located on said pads.

8. The electron emitter plate of claim 7, wherein said second layer of conductive material is patterned to form pads respectively located centrally within said mesh spacings, and bridging strips electrically connecting said pads to neighboring pads; said aperture clusters being respectively located on said pads; and wherein said beam comprises a layer of material deposited over said second layer of conductive material in a cross-shaped pattern aligned with said bridging strips.

9. The electron emitter plate of claim 8, wherein said second layer of conductive material is patterned to form pads respectively located centrally within said mesh spacings; said pads including corners; and wherein said beam comprises a layer of material deposited over said second layer of conductive material in a cross-shaped pattern aligned with said corners.

10. An electron emitter plate comprising:

a substrate;

a first layer of conductive material deposited on said substrate;

a layer of insulating material deposited on said substrate over said first layer of conductive material;

a second layer of conductive material deposited on said substrate over said layer of insulating material; said second layer of conductive material having a plurality of apertures; said apertures extending through said insulating layer;

a conductive microtip formed in each aperture in electrical communication with said first layer of conductive material;

said insulating layer being formed with a cavity connecting said apertures and commonly containing said microtips; and a layer of material deposited on said substrate over said second layer of conductive material, said layer of material being patterned into a supporting beam structure, spanning said cavity and supporting said second layer of material above said first layer of conductive material, centrally of said cavity.

11. The electron emitter plate of claim 10, wherein said layer of material patterned into a supporting beam structure being of the same material as said microtips.

12. The electron emitter plate of claim 10, wherein said first layer of conductive material is patterned in stripes; and said second layer of conductive material is patterned in cross-stripes; said stripes and cross-stripes intersecting at pixel-defining locations.

13. An image display device comprising the electron emitter plate of claim 10, and further comprising an anode plate spaced from said emitter plate and including an anode substrate, another layer of conductive material deposited on said anode substrate, and cathodoluminescent material in electrical communication with said another layer of conductive material.

* * * * *